US012551041B2

(12) United States Patent
Reisner

(10) Patent No.: US 12,551,041 B2
(45) Date of Patent: Feb. 17, 2026

(54) COLLAPSIBLE ACCESSORIES FOR CONTAINERS

(71) Applicant: Chase Reisner, Wilmington, DE (US)

(72) Inventor: Chase Reisner, Wilmington, DE (US)

( * ) Notice: Subject to any disclaimer, the term of this patent is extended or adjusted under 35 U.S.C. 154(b) by 0 days.

(21) Appl. No.: 18/628,638

(22) Filed: Apr. 5, 2024

(65) Prior Publication Data

US 2025/0311871 A1 Oct. 9, 2025

(51) Int. Cl.
*A47G 23/00* (2006.01)
*A47G 23/02* (2006.01)
*A47G 23/03* (2006.01)

(52) U.S. Cl.
CPC ..... *A47G 23/03* (2013.01); *A47G 23/0216* (2013.01)

(58) Field of Classification Search
None
See application file for complete search history.

(56) References Cited

U.S. PATENT DOCUMENTS 2,727,645 A * 12/1955 Dore ..... A47G 23/03 215/393
3,491,976 A * 1/1970 Larson ..... A47B 13/16 215/393
4,969,618 A * 11/1990 Thompson ..... A47G 7/025 248/346.11
5,018,695 A * 5/1991 Bishop ..... B32B 7/02 248/346.11
5,154,380 A * 10/1992 Risca ..... B60N 3/106 248/154
5,560,578 A * 10/1996 Schenken ..... B60N 3/106 248/229.21
10,562,430 B1 * 2/2020 Veillon ..... B60N 3/103
2004/0125594 A1 * 7/2004 Wu ..... A47G 23/0309 362/276
2006/0113200 A1 * 6/2006 Abkarian ..... G11B 33/0422 206/217
2020/0146485 A1 * 5/2020 Vasquez ..... B01J 20/28016

* cited by examiner

*Primary Examiner* — Steven M Marsh
(74) *Attorney, Agent, or Firm* — Stetina Garred Brucker & Newboles

(57) ABSTRACT

Accessories for use with a container are disclosed which may be collapsible to allow a user to transport the accessory with the container. These accessories include a coaster and a sleeve, which may entirely occupy a recess by the container on a bottom thereof while the accessory is in its collapsed configuration. The accessory may have a series of fold lines defining portions thereof, allowing a user to expand or collapse the accessory by folding or unfolding those portions along their respective fold lines.

8 Claims, 4 Drawing Sheets

COLLAPSIBLE ACCESSORIES FOR CONTAINERS

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Field of Invention

The present application relates to accessories for use with a beverage container, including coasters and sleeves. More specifically, the present application relates to collapsible accessories which allow a user to transport the container and accessory with ease and expand the accessory to make it usable as a coaster or a sleeve.

2. Related Art

Various accessories exist for use with containers holding beverages, including coasters and sleeves. These accessories, however, are typically separate from their containers and thus necessitate a user to carry a spare accessory around with them or simply live without the benefits such accessories may yield. Many see disposable coasters and sleeves as a suitable substitute, but this can contribute to a large amount of waste that could be avoided with reusable accessories; even then, these disposable accessories may not be readily obtainable to a user. It can be seen that accessories for beverage containers which allow a user to transport the accessory alongside the container with ease and reuse that accessory are needed and desired in the art.

BRIEF SUMMARY

To solve these and other problems, collapsible accessories are contemplated which allow a user to transport those accessories with ease and thereafter expand the accessories to enjoy the benefits associated therewith. Such accessories include a coaster which may interpose its associated container and an underlying surface the base of the container is adjacent thereto and a sleeve which may shield a user's hand from heat emanating from a hot beverage contained in the container. By virtue of these accessories having fold lines which define movable portions thereof, the a user may expand and collapse these accessories whenever they see fit.

With respect to a coaster accessory, a container for holding beverages may comprise a coaster which may be operative to transition between an expanded configuration and a collapsed configuration. In the expanded configuration, the coaster may be allowed to interpose the container and an underlying surface a bottom of that container is adjacent thereto. In the collapsed configuration, the coaster may be compressed relative to the expanded configuration. The container could define a recess on a bottom thereof, and in such an embodiment, the coaster could entirely occupy this recess when in the collapsed configuration. The coaster could be attached to the bottom of the container with an adhesive.

The collapsed configuration of the coaster may expose one or more portions of the coaster, each of which could be defined by fold lines of the coaster. There could be three of these portions exposed in the collapsed configuration. The coaster may be at least partially expanded via these one or more portions of the collapsed configuration being movable relative to the container and the one or more portions of the collapsed configuration being operative to be unfolded along their respective fold lines.

The coaster could further be operative to transition from the collapsed configuration to an intermediate configuration when the one or more portions exposed in the collapsed configuration are unfolded. The intermediate configuration could itself expose one or more portions of the coaster. There could be three of these portions exposed in the intermediate configuration. These one or more portions of the intermediate configuration can each be defined by fold lines of the coaster. The coaster could be at least partially expanded further via the one or more portions of the intermediate configuration being movable relative to the container and the one or more portions of the intermediate configuration being operative to be unfolded along their respective fold lines. Unfolding the portions exposed in the intermediate configuration may cause the coaster to transition to the expanded configuration.

With respect to a sleeve accessory, a container for holding beverages may comprise a sleeve operative to transition between a coupled configuration, an expanded configuration, and a collapsed configuration. The sleeve may at least partially surround a periphery of the container while in the coupled configuration. The sleeve could be compressed in the collapsed configuration, relative to the expanded configuration. The container could define a recess on a bottom thereof, and the sleeve could entirely occupy this recess while the sleeve is in the collapsed configuration. The sleeve can be attached to a bottom of the container with an adhesive.

The sleeve may comprise one or more connectors and define one or more slits. Each of the one or more slits could be associated with a respective connector amongst the one or more connectors. The one or more slits could receive their respective connectors when the sleeve is in its coupled configuration.

The sleeve may comprise a body portion and one or more arm portions. The one or more arm portions could be defined by fold lines of the sleeve, and these arm portions may be movable relative to the container. While the sleeve is in the collapsed configuration, the one or more arm portions may be folded along their respective fold lines.

The sleeve could further be operative to transition from the collapsed configuration to a first intermediate configuration when a first one of the one or more arm portions are unfolded along its respective fold line. The sleeve may be further operative to transition from the collapsed configuration to a second intermediate configuration when each of the one or more arm portions are unfolded along their respective fold lines. The sleeve could define one or more cutouts associated with each of the one or more arm portions.

The second intermediate configuration can expose one or more layered arrangements each associated with the one or more arm portions. Each of the one or more layered arrangements may comprise a connector portion and a slit portion. The connector portions could be defined by a respective fold line, and these connector portions may be movable to the container. Similarly, the slit portions could be defined by a respective fold line and may be movable relative to the container.

The sleeve could further be operative to transition from the second intermediate configuration to a third intermediate configuration when the connector portions are unfolded along their respective fold lines. The sleeve may be further be operative to transition from the second intermediate configuration to the expanded configuration when the connector portions are unfolded along their respective fold lines and the slit portions are also unfolded along their respective fold lines.

The container could define one or more gaps on a bottom thereof corresponding to each of the one or more arm portions such that the one or more arm portions occupy the gap when the sleeve is in the second intermediate configuration, the expanded configuration, and the coupled configuration.

All of these embodiments are contemplated to be within the scope of this disclosure. These and other embodiments will become readily apparent to those skilled in the art form the following detailed description of the preferred embodiments having reference to the attached figures, the disclosure not being limited to any particular preferred embodiment.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

Disclosed herein are collapsible accessories for use with a container holding a beverage. These accessories include coasters and sleeves, both of which may have a collapsed configuration in which the accessory could be compressed and relatively easy to transport. These accessories can be transitioned to an expanded configuration, allowing the accessory to function similar to conventional coasters and sleeves used in conjunction with beverage containers. An accessory may have fold lines dividing portions of the accessory which a user may fold/unfold along those fold lines to expand and collapse the accessory as desired.

This description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
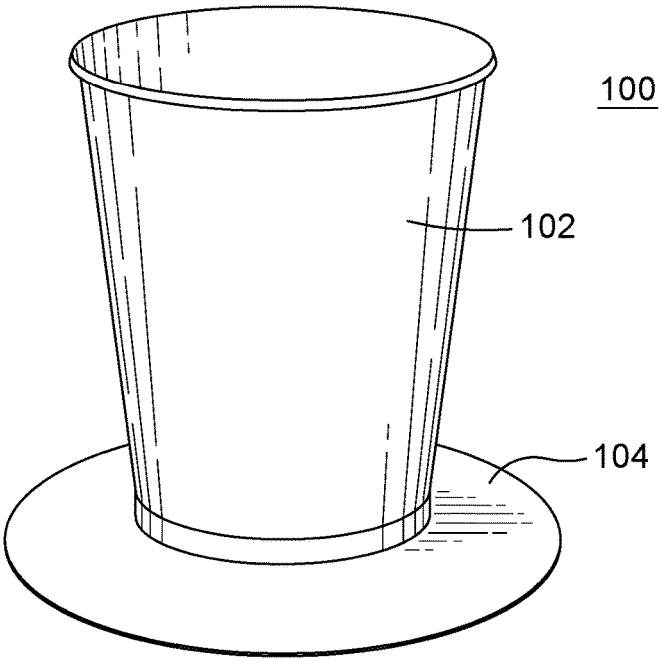
FIG. 1 is a perspective view of a first embodiment of a container with a coaster accessory in an expanded configuration.

Referring first to FIG. 1, a perspective view of a first embodiment of a container with a coaster accessory in an expanded configuration is shown. A container 102 may hold a beverage and be constructed to allow a user to access that beverage, such as via the container 102 defining an aperture on a top thereof, through which a user may drink the beverage. In this respect, the container 102 may be substantially similar or largely the same as conventional containers known in the art, including mugs, bottles, glasses, plastic cups, Styrofoam cups, and the like, or any future developed container types. Preferably, the container 102 would be sized and shaped to allow a user to comfortably hold and transport the container 102 with their hand.

A container 102 may include an accessory, such as a coaster 104. This coaster 104 may be uniquely configured to collapse, as will be illustrated and discussed with respect to FIGS. 2-6. When a coaster 104 is in an expanded configuration 100, it may function similar to conventional coasters in that the coaster 104 may interpose a container 102 and an underlying surface, like a table or countertop, a bottom of the container 102 is adjacent thereto so that the coaster 104 may protect the underlying surface from condensation formed on surface of the container 102, a hot temperature from a beverage held in the container 102, etc. In this respect, the coaster 104 may incorporate features of conventional coasters, such as insulating materials, frictional surfaces, etc., or those used in future developed coasters. A coaster 104 would preferably keep the container 102 stable and approximately level relative to the underlying surface a bottom of the container 102 is adjacent thereto.

Figure 2:
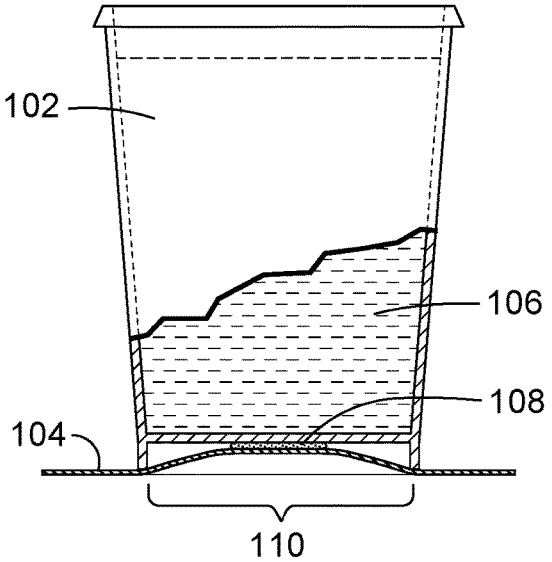
FIG. 2 is a partial side cross-sectional view of the container of FIG. 1.
Figure 3:
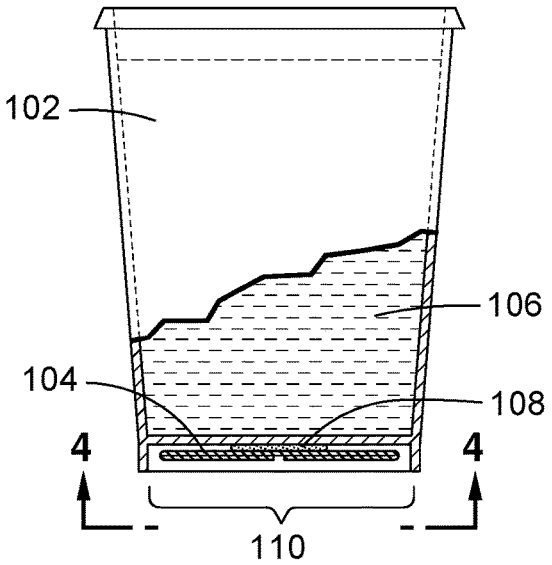
FIG. 3 is the partial side cross-sectional view of the container FIG. 2 with the coaster accessory in a collapsed configuration.

Looking now at FIGS. 2 and 3, partial side cross-sectional views of the container of FIG. 1 with the coaster accessory in an expanded and collapsed configuration respectively are shown. A coaster 104 may be attached to a container 102 with an adhesive 108, but alternative attachment mechanisms may used, including as fastening, sockets that allow for a frictional engagement, magnetic attraction between the coaster 104 and container 102, and more. Combinations of these mechanisms can also be used to attach a coaster 104 to a container 102. If an adhesive 108 is used, preferably the adhesive would substantially retain its adhesive capabilities, even the container 102 is intended to hold and/or cold beverages (since some adhesives could weaken when exposed to extreme temperatures). This can be achieved with a particular selection of adhesive and/or manufacturing the container 102 with insulating materials. Ideally, the coaster 104 would not need to be detached from its associated container 102, but a coaster 104 could be designed to be detachable in this manner, allowing a user to combine a given container with a different coaster and vice versa.

A coaster 104 may be collapsible such that the coaster 104 can transition between the aforementioned expanded configuration 100 (shown in FIGS. 1 and 2) and a collapsed configuration (shown in FIG. 3). A container 102 may be designed to define a recess 110 on a bottom thereof; a coaster 104 could partially occupy this recess 110 while in the expanded configuration 100, but while the coaster 104 is in its collapsed configuration, it may entirely occupy and nestle within this recess 110. When a coaster 104 is in a collapsed configuration and tucked in the recess 110, the container 102 may, in essence, be a free container without an interposing coaster attached underneath, allowing a bottom of the container 102 to rest directly upon an underlying surface and/or the container 102 to fit within tighter spaces. In this respect, the coaster 102 may be compressed while in its collapsed configuration, relative to its expanded configuration 100. This may afford a user convenience and flexibility in transporting the container 102 while enjoying the benefits of the coaster 104 across various locations. For example, the coaster 104 could be transitioned to the collapsed configuration to allow the container 102 to be held in a user's hand comfortably, received by a cup holder in a vehicle, and/or held with a bag; thereafter the user could transition the coaster 104 to the expanded configuration 100 when they desire to rest a bottom of the container 102 upon some underlying surface. Furthermore, any need for a user to carry a separate coaster with them or have multiple coasters laid out throughout their home can be eliminated with this collapsible coaster 104.

Figure 4:
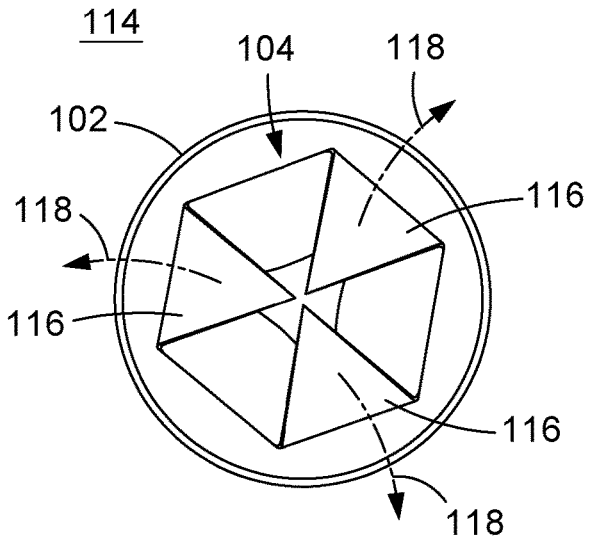
FIG. 4 is a bottom view of the container taken along line 4-4 of FIG. 3.
Figure 5:
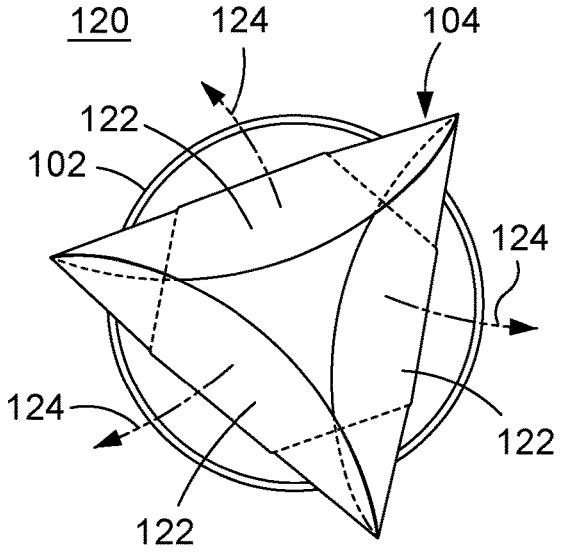
FIG. 5 is the bottom view of the container of FIG. 4 with the coaster accessory in an intermediate configuration.
Figure 6:
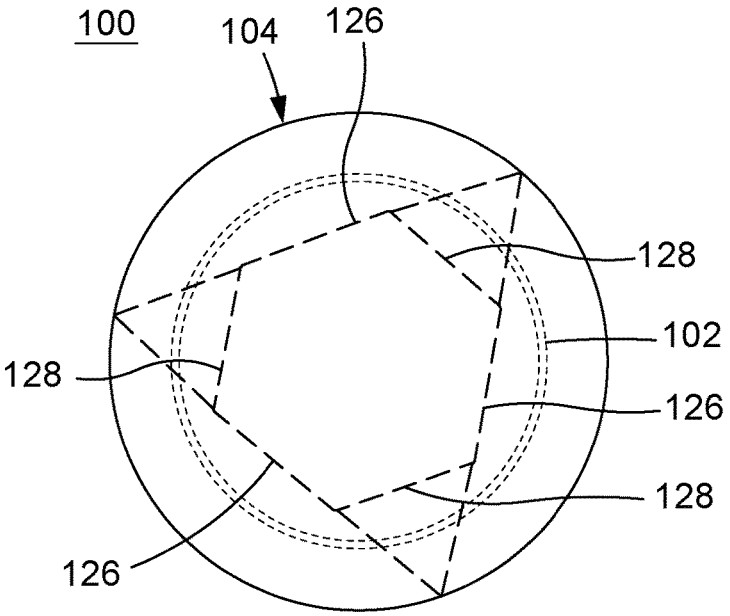
FIG. 6 is the bottom view of the container of FIG. 5 with the coaster accessory in the expanded configuration.

For a coaster 104 to be expandable and collapsible, a coaster 104 could be constructed to obtain a certain degree of flexibility: pliable enough to be expanded and contracted, but rigid enough to function like a conventional coaster when in the expanded configuration. To achieve this flexibility, the coaster 104 may be manufactured from materials like papers, plastics, foams, and combinations thereof and/or the coaster 104 may be constructed to exhibit pliability or rigidity in particular portions thereof. In this respect, it is envisioned that a coaster 104 may have fold lines defining movable portions of the coaster 104 which a user can fold or unfold to collapse or expand the coaster 104. An exemplary design for such a coaster 104 is illustrated in FIGS. 4-6 which show how a particular coaster 104 may be folded and unfolded to transition between a circular expanded configuration, a collapsed configuration, and an intermediate configurations therebetween. That being said, it is envisaged that various folding schemes may exist with their own sets of fold lines and ensuing portions that also can allow a coaster to transition between expanded, collapsed, and intermediate configurations.

Referring now to FIG. 4, a bottom view of the container taken along line 4-4 of FIG. 3 is shown. While in the collapsed configuration 114, one or more portions 116 of a coaster 104 may be exposed. These portions 116 may be movable relative to the container 102 such that a user may unfold 118 these portions 116 with their hands and fingers. The portions 116 may be unfolded 118 along fold lines 128 (shown in FIG. 6) defining these portions 116 to progress from the collapsed configuration 114 towards an expanded configuration 100. The number of portions 116 in the collapsed configuration 114 may depend on the folding scheme of a coaster 104, but ideally this number would be kept low to avoid any hassle and difficulty a user may experience when expanding the coaster 104. The preferred embodiment of a coaster 104 would expose three portions 116 in the collapsed configuration 114. The exposed portions 116 may be shaped to allow a user to more easily pry, grip, or otherwise manipulate the portions 116, as may be the case with triangularly shaped portions.

Looking now to FIG. 5, the bottom view of the container of FIG. 4 with the coaster accessory in an intermediate configuration is shown. Following the unfolding 118 of any portions 116 exposed in the collapsed configuration 114, a coaster 104 may be in an intermediate configuration 120. One or more intermediate configurations may exist between the expanded 100 and collapsed 114 configurations of a coaster 104 depending on its folding scheme, but ideally only one is necessary. Like the collapsed configuration 114, one or more portions 122 of the coaster 104, which could be movable relative to the container 102, may be exposed in this intermediate configuration 120. By unfolding 124 these portions 122, which can be done by a user with their hands and fingers, a user could further progress towards the expanded configuration 100 of the coaster 104. The number of portions 122 exposed in the intermediate configuration 120 may depend on the folding scheme of a coaster 104, but ideally this number would be low to avoid any hassle and difficulty a user may experience when expanding the coaster 104. The preferred embodiment of a coaster 104 would expose three portions 122 in the intermediate configuration 120. Since the coaster 104 may be expanded relative to the collapsed configuration 114 but not fully interpose a bottom of a container relative to the expanded configuration 100, the intermediate configuration 120 may not have a functional purpose like the collapsed configuration 114 and expanded configuration 100 and may simply be a necessity for the coaster 104 to compress and expand between the collapsed 114 and expanded configurations 100.

The exposed portions 122 may be shaped to allow a user to more easily pry, grip, or otherwise manipulate the portions 122, as may be the case with triangularly shaped portions. If, for instance, two intermediate configurations exist, such as a first intermediate configuration and a second intermediate configuration, unfolding the portions of a coaster in a first intermediate configuration may transition the coaster to a second intermediate configuration, which itself may expose another set of portions of the coaster to be unfolded before the coaster fully expands. Similar processes could follow if a folding scheme of a coaster results in three intermediate configurations, four intermediate configurations, and so on.

Referring now to FIG. 6, the bottom view of the container of FIG. 5 with the coaster accessory in the expanded configuration is shown. With the coaster 104 in the expanded configuration 100, the coaster 104 may fully interpose a container 102 and an underlying surface a bottom of that container 102 is adjacent thereto. In this respect, a diameter of the coaster 104 in the expanded configuration 100 may be larger than a diameter of a bottom of the container 102. It can be seen in this expanded configuration 100 that fold lines 126, 128 may divide the coaster 104 to define the portions 116, 122 exposed in the collapsed 114 and intermediate 120 configurations. Whenever a user wishes to transition back to the collapsed configuration 114, they may fold the coaster along fold lines to reverse the sequence of unfolding 118, 122 steps originally taken to transition the coaster 104 to the expanded configuration 100. In the exemplary coaster 104 depicted in FIG. 6, this may be done by first folding the coaster 104 along a first set of fold lines 126 to arrive at the intermediate configuration 120, followed by folding the coaster 104 along a second set of fold lines 128 to arrive at the collapsed configuration 114. A coaster 104 may be colored, annotated, and/or contoured to guide a user in properly folding/unfolding the coaster 104. In this manner, fold lines 126, 128 and/or portions 116, 122 ensuing from a folding scheme may be made readily discernable to a user.

Figure 7:
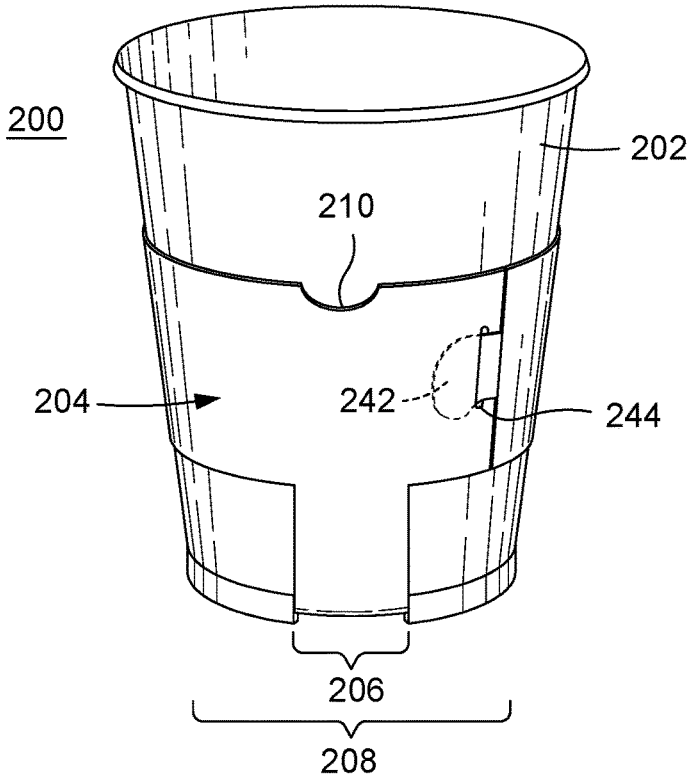
FIG. 7 is a perspective view of a second embodiment of a container with a sleeve accessory in a coupled configuration.

Looking now to FIG. 7, a perspective view of a second embodiment of a container with a sleeve accessory in a coupled configuration is shown. A container 202 may be substantially the same as the previously discussed container 102, such as having the capability of defining a recess 208 on a bottom thereof. This container 202, however, may differ in that this container 202 may better accommodate a collapsible sleeve 204 accessory by virtue of the container 202 defining one or more gaps 206 on a bottom thereof, which will be expanded upon later in this disclosure.

A sleeve 204 of may, while in a coupled configuration 200, function similar to conventional sleeves used to protect a user's hand from heat emanating from a warm/hot beverage held in a container the user is holding; a common example of this kind of sleeve is the cardboard sleeves wrapped around polyethylene containers used to hold hot coffee. To achieve a similar result, a sleeve 204 of this present disclosure may at least partially be made of insulating materials or other features used in conventional and future developed sleeves to shield a user's hands holding the container 202 from any harm that may otherwise ensue from touching the outer surfaces of a container 202 directly. A sleeve 204 may at least partially or fully surround a periphery of a container 202 when in the coupled configuration 200, corresponding to the area a user's hand may wrap around the container 202. To obtain and maintain a coupled configuration 200, a sleeve can comprise connectors 242 and define slits 244 operative to receive that connector 242. Connectors 242 can be removed from their silts 244 to transition the sleeve 204 to an expanded configuration, an example of which will be described in relation to FIG. 12.

A sleeve 204 may, similar to the coaster 104 described above, be collapsible to allow the sleeve 204 to transition between a coupled configuration 200, an expanded configuration, a collapsed configuration, and any intermediate configurations therebetween. A sleeve 204 may define one or more cutouts 210 which could allow a user to transition between certain configurations of the sleeve 204 with greater ease, as will be discussed momentarily.

For a sleeve 204 to be expandable and collapsible, a sleeve 204 could be constructed to obtain a certain degree of flexibility: pliable enough to be expanded and contracted, but rigid enough to function like a conventional sleeve when in the coupled configuration. To achieve this flexibility, the sleeve 204 may be manufactured from materials like papers, plastics, foams, and combinations thereof and/or the sleeve 204 may be constructed to exhibit pliability or rigidity in particular portions thereof. In this respect, it is envisioned that a sleeve 204 may have fold lines defining movable portions of the sleeve 204 which a user can fold or unfold along those fold lines to collapse or expand the sleeve 204. An exemplary design for such a sleeve 204 is illustrated in FIGS. 8-12 which show how a particular sleeve 204 may be folded and unfolded to transition between an expanded configuration, a collapsed configuration, and three intermediate configurations therebetween. That being said, it is envisaged that various alternative folding schemes may exist with their own set of fold lines and ensuing portions that can similarly allow a sleeve to transition between expanded, collapsed, and any intermediate configurations therebetween.

Figure 8:
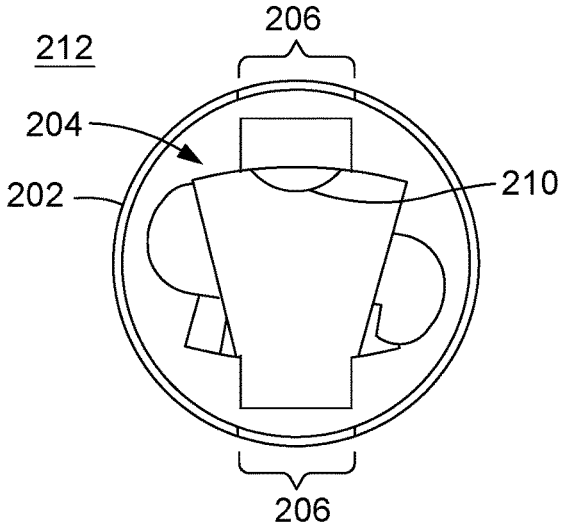
FIG. 8 is a bottom view of the container of FIG. 7 with the sleeve accessory in a collapsed configuration.

Turning now to FIG. 8, a bottom view of the container of FIG. 7 with the sleeve accessory in a collapsed configuration is shown. A sleeve 204 may be attached to a container 202 with any of the attachment mechanisms previously discussed in relation to the coaster 104. The sleeve 204 may not need to be detached from its associated container 202, but a sleeve 204 could be designed to be detachable in this manner, allowing a user to combine a given container with a different sleeve and vice versa. A sleeve 204 could partially occupy a recess 208 defined by a container 202 while the sleeve 204 is in the coupled configuration 200, expanded configuration, and any intermediate configurations that the sleeve 204 may have. While the sleeve 204 is in its collapsed configuration, it may entirely occupy and nestle within this recess 208. A user may therefore transition between the coupled 200 and collapsed configurations 222 of the sleeve 204 when they desire to drink their beverage with or without the effects and benefits of having a sleeve wrapped around their container 202. Also, the collapsible configuration 222 may ensure that a user has access to a protective sleeve by simply bringing this particular container 202 with them, thus avoiding the need to look for or carry around a separate sleeve with them. To help expand the collapsed sleeve 204 and progress towards the coupled configuration 200, the sleeve 204 could define one or more cutouts 210 to allow a user to reach under the cutout 210, such as with one or more of their fingers, to pry at and begin unfolding an arm portion of the sleeve 204. A cutout 210 may be exposed in the collapsed configuration 212 of the sleeve 204 to begin the unfolding process.

Figure 9:
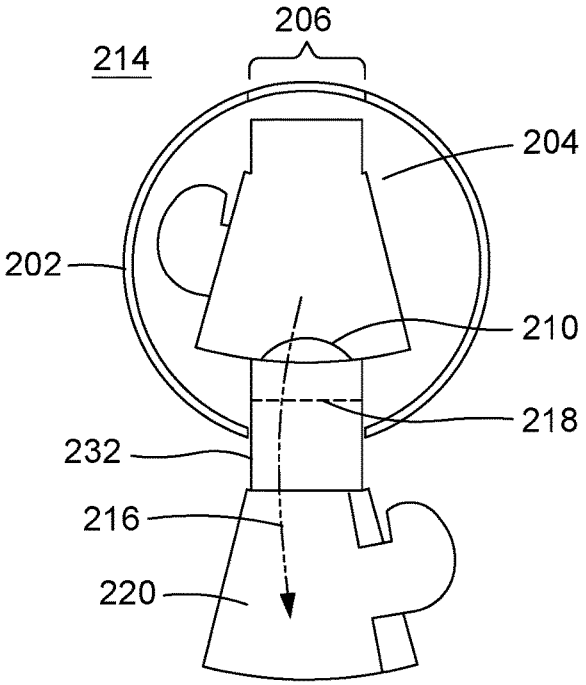
FIG. 9 is the bottom view of the container of FIG. 8 with the sleeve accessory in a first intermediate configuration.

Referring now to FIG. 9, the bottom view of the container of FIG. 8 with the sleeve accessory in a first intermediate configuration is shown. An arm portion 232 of the sleeve 204 may be unfolded 216 to arrive at a first intermediate configuration 214 of the sleeve 204. Specifically, an arm portion 232 could be unfolded 216 along a folding line 218; in this manner, the arm portion 232 may be movable relative to the container 202. Unfolding 216 a first arm portion 232 in this manner may expose another cutout 210 which a user can similarly manipulate move another arm portion and unfold the sleeve 204 further towards its open configuration.

Figure 10:
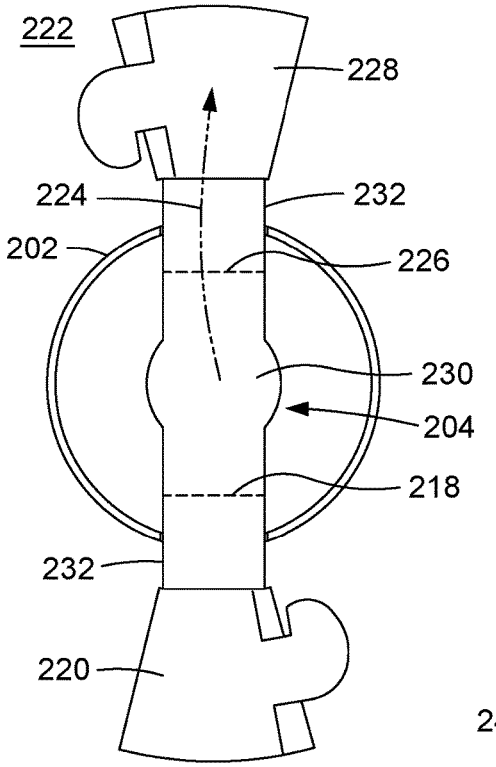
FIG. 10 is the bottom view of the container of FIG. 9 with the sleeve accessory in a second intermediate configuration.

Turning now to FIG. 10, the bottom view of the container of FIG. 9 with the sleeve accessory in a second intermediate configuration is shown. To obtain a second intermediate configuration 222 of a sleeve 204, a second arm portion 232 of the sleeve 204 can be unfolded 224 along its respective fold line 224; in this respect, the second arm portion 232 may movable relative to the container 202. The arm portions 232 need not be stacked upon each other in a certain order in the collapsed configuration 212, nor does a certain arm portion 232 need to be unfolded before the other, but a sleeve 204 could be constructed to require or encourage a certain ordering. A sleeve 204 could comprise a body portion 230, which could be at the center of the container 202, and one or more arm portions 232 connected thereto, which may be defined by and divided by fold lines 218, 226. Preferably, there are just two arm portions 232, but there could be just one or more than two, whereby unfolding successive arm portions 232 may result in the next intermediate configuration which allows the next arm portion 232 to be unfolded, which may be assisted by another cutout 210 being exposed. A configuration of the sleeve 204 may be designated in which all of the arm portions 232 of a sleeve 204 are unfolded along their respective fold lines 218, 226; which intermediate configuration (i.e., second, third, fourth, and so on) this occurs may depend on the specific sleeve and how many arm portions 232 are present, but in the context of a sleeve 204 with two arm portions 232, the second intermediate configuration 222 may be this designated configuration. Each arm portion 232, when unfolded along their respective fold lines 218, 226, may occupy gaps 206 defined by the container 202 and positioned in relation to the arm portions 232 of the sleeve 204. Such gaps 206 may give the sleeve 204 the leeway to bend and contort into the coupled configuration 200, like that shown in FIG. 7. Following the unfolding of an arm portion 232, a layered arrangement 220 may be exposed composed of a connector portion and a slit portion, which a user could unfold to further progress to the expanded configuration.

Figure 11:
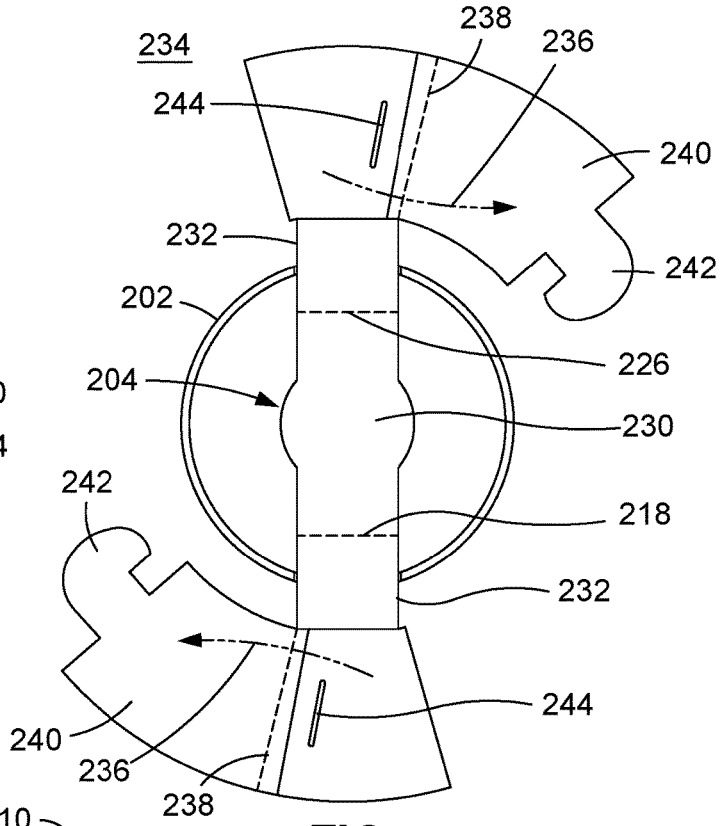
FIG. 11 is the bottom view of the container of FIG. 10 with the sleeve accessory in a third intermediate configuration.

Looking now to FIG. 11, the bottom view of the container of FIG. 10 with the sleeve accessory in a third intermediate configuration is shown. Connector portions 240 of a sleeve 204 may be defined by respective fold lines 238 and unfolding 236 these connector portions 240 may result in the sleeve 204 transitioning to a third intermediate configuration 234. This unfolding mechanism may allow the connector portions 240 to be movable relative to the container 202. In a preferred embodiment, one connector portion 240 is associated with each arm portion 232 of a sleeve 204. After unfolding 236, connectors 242 may become accessible and ready to be received by a slit 244. A sleeve 204 could define cutouts 210 associated with the connector portions 240, which may be exposed in the prior configuration of the sleeve 204, such as the second intermediate configuration 222, to assist a user in unfolding 236.

Figure 12:
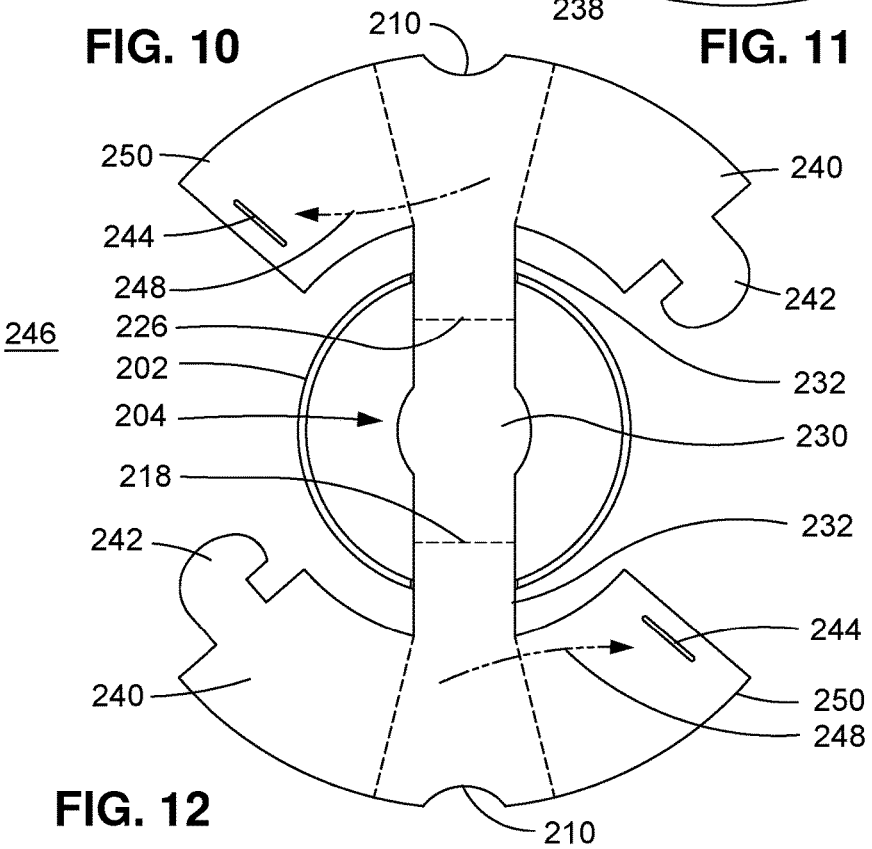
FIG. 12 is the bottom view of the container of FIG. 11 with the sleeve accessory in an expanded configuration.

Referring now to FIG. 12, the bottom view of the container of FIG. 11 with the sleeve accessory in an expanded configuration is shown. It can be seen that the sleeve 204 may be compressed in the collapsed configuration 212 relative to this expanded configuration 246. Slit portions 250 of a sleeve 204 may be defined by respective fold lines and unfolding 248 these slit portions 250 may result in the sleeve 204 transitioning to an expanded configuration 246. This folding mechanism may therefore allow the slit portions 250 to be movable relative to the container 202. In a preferred embodiment, one connector portion 240 is associated with each arm portion 232 of a sleeve 204. After unfolding 248, slits 244 may become accessible and ready receive a connector 242. A sleeve 204 could define cutouts 210 associated with the slit portions 250, which may be exposed in the prior configuration of the sleeve 204, such as the third intermediate configuration 234, to assist a user in unfolding 248. By contorting the sleeve 204 and inserting connectors 242 into their intended slits 244, a sleeve 204 may achieve the coupled configuration 200, such as that shown in FIG. 7. It can be seen that, depending on the size of the connector portions 240, slit portions 250, and arm portions 232, an arm portion 232 may be associated with a subset of the sleeve 204 when surrounding the periphery of the container 202 in the coupled configuration 200. The preferred embodiment, for instance, has two arm portions 232 which are each associated with half or 180 degrees of a sleeve 204 surrounding the periphery of a container 202, although alternative embodiments where arm portions are associated with an unequal amount of the container 202 or greater/lesser subsets of the sleeve 204 may also me employed.

Whenever a user wishes to transition back to the collapsed configuration 212 of the sleeve 204, they may uncouple any connectors 242 from their associated slits 244 and begin to fold the sleeve 204 along fold lines 218, 226, 238 to reverse the sequence of unfolding 216, 224, 236, 248 steps originally taken to transition the sleeve 204 to the expanded configuration 246. A sleeve 204 may be colored, annotated, and/or contoured to guide a user in properly folding/unfolding the sleeve 204. In this manner, fold lines 218, 226, 238 and/or portions 230, 232, 240, 250 ensuing from a folding scheme may be made readily discernable to a user.

The above description is given by way of example, and not limitation. Given the above disclosure, one skilled in the art could devise variations that are within the scope and spirit of this disclosure. Further, the various features of the embodiments disclosed herein can be used alone, or in varying combinations with each other and are not intended to be limited to the specific combination described herein. Thus, the scope of the claims is not to be limited by the illustrated embodiments. Additional modifications and improvements of the present disclosure may also be apparent to those of ordinary skill in the art. Thus, the particular combination of parts and steps described and illustrated herein is intended to represent only certain embodiments of the present subject matter and is not intended to serve as limitations of alternative devices and methods within the spirit and scope of this disclosure.

What is claimed is:

1. A container, the container comprising:

a bottom surface;

a coaster coupled to the bottom surface of the container, the coaster being operative to transition between an expanded configuration and a collapsed configuration while remaining coupled to the bottom surface of the container;

wherein in the expanded configuration, the coaster is operative to be interposed between the container and an underlying surface the bottom of the container is adjacent thereto;

wherein in the collapsed configuration, the coaster is compressed relative to the expanded configuration.

2. The container of claim 1, wherein the bottom surface of the container defines a recess; and wherein the coaster is entirely positioned within the recess when in the collapsed configuration.

3. The container of claim 1, wherein the coaster is attached to the bottom surface of the container with an adhesive.

4. The container of claim 1, wherein one or more portions of the coaster are defined by fold lines, the one or more portions of the collapsed configuration being movable relative to the container, and in the collapsed configuration, the one or more portions of the coaster are being operative to be unfolded along their respective fold lines to at least partially expand the coaster.

5. The container of claim 4, wherein three portions of the coaster are exposed in the collapsed configuration.

6. The container of claim 4, wherein the coaster is further operative to transition from the collapsed configuration to an intermediate configuration wherein one or more portions folded in the collapsed configuration are unfolded, the coaster in the intermediate configuration exposing one or more portions of the coaster, the one or more portions of the intermediate configuration each being defined by fold lines, the one or more portions of the intermediate configuration being movable relative to the container, the one or more portions of the intermediate configuration being operative to be unfolded along their respective fold lines to at least partially expand the coaster.

7. The container of claim 6, wherein three portions of the coaster are exposed in the intermediate configuration.

8. The container of claim 6, wherein the coaster is operative to transition from the intermediate configuration to the expanded configuration when the one or more portions exposed in the intermediate configuration are unfolded along their respective fold lines.

* * * * *